US008419237B2

(12) United States Patent
Tsai

(10) Patent No.: US 8,419,237 B2
(45) Date of Patent: Apr. 16, 2013

(54) HEAT SINK AND LIGHT EMITTING DIODE LAMP

(75) Inventor: Wen-Kuei Tsai, Taipei County (TW)

(73) Assignee: Top Energy Saving System Corp., Wugu Township, Taipei County (TW)

( * ) Notice: Subject to any disclaimer, the term of this patent is extended or adjusted under 35 U.S.C. 154(b) by 481 days.

(21) Appl. No.: 12/719,014

(22) Filed: Mar. 8, 2010

(65) Prior Publication Data

US 2011/0215723 A1 Sep. 8, 2011

(51) Int. Cl.
*F21V 29/00* (2006.01)

(52) U.S. Cl.
USPC ..... 362/373; 362/294; 362/345; 362/218

(58) Field of Classification Search ..... 362/373, 362/294, 345, 218
See application file for complete search history.

(56) References Cited

U.S. PATENT DOCUMENTS 5,980,306 A * 11/1999 Tanaka et al. ..... 439/485
2009/0040776 A1 * 2/2009 Zhang et al. ..... 362/373
2009/0129086 A1 * 5/2009 Thompson, III ..... 362/249.02

* cited by examiner

*Primary Examiner* — William Carter
(74) *Attorney, Agent, or Firm* — Muncy, Geissler, Olds & Lowe, PLLC

(57) ABSTRACT

A heat sink including an inner piece and an outer piece is provided. The inner piece has a side surface. The outer piece is disposed around the inner piece and has an inner side surface, wherein the side surface of the inner piece is riveted to the inner side surface of the outer piece to form an interface, and an area ratio of the interface and the side surface of the inner piece is between 0.6 and 0.95. The light emitting diode lamp using the heat sink is also provided.

15 Claims, 2 Drawing Sheets

HEAT SINK AND LIGHT EMITTING DIODE LAMP

BACKGROUND OF THE INVENTION

1. Field of the Invention

The present invention generally relates to a heat dissipation element and an illumination device. More particularly, the present invention relates to a heat sink and a light emitting diode (LED) lamp having high heat dissipation efficiency.

2. Description of Related Art

LEDs are semiconductor devices. The light emitting chips are mainly made of a compound semiconductor material containing III-V group chemical elements, for example, GaP, GaAs, and the like, and function on the principle of converting electric energy to light. That is to say, the compound semiconductor is powered to release excessive energy through the combination of electrons and holes, so as to emit photon (light). The LED can emit light without being heated or does not discharge to emit light. Therefore, the lifespan of the LED is up to 100,000 hours, and an idling time is not required. In addition, the LED has advantages of quick response speed (approximately $10^{-9}$ seconds), small volume, power-saving, low pollution, high reliability, and ease mass production. Thus, the LEDs have been intensively used in many fields, for example, light source and illumination device in large-scale bulletin boards, traffic lights, cellular phones, scanners, fax machines, etc.

Currently, the light emitting brightness and efficiency of the LEDs are continuously improved, and meanwhile the white LEDs with high brightness are successfully put into mass production, so the white LEDs have been gradually used in illumination devices such as indoor illumination and outdoor street lamp. Generally, heat dissipation performance is important to high power LEDs. If LEDs operates under high temperature, the brightness that the LED light can provide may be reduced and the life span thereof is reduced. Therefore, how to enhance heat dissipation performance of LEDs is an important topic for research and development people.

Currently, the heat dissipation element of the LEDs is made of aluminium by extrusion, and this method will cause material waste since the remaining aluminium after extruding is discarded. Namely, the remaining aluminium has fallen into disuse. In addition, materials that can be used in this method are limited to materials which have good extension capability.

SUMMARY OF THE INVENTION

The present application is directed to a heat sink that can help dissipate heat generated from the heat generating apparatus.

The present application is directed to a light emitting diode lamp with good heat dissipation performance.

The present invention provides a heat sink including an inner piece and an outer piece. The inner piece has a side surface. The outer piece is disposed around the inner piece and has an inner side surface, wherein the side surface of the inner piece is riveted to the inner side surface of the outer piece to form an interface, and an area ratio of the interface and the side surface of the inner piece is between 0.6 and 0.95.

In an embodiment of the present invention, a material constituting the inner piece comprises copper, aluminium, ceramic or aluminum nitride (AlN).

In an embodiment of the present invention, a material constituting the outer piece comprises aluminium.

In an embodiment of the present invention, a thickness of the inner piece is between 1 millimeter and 10 millimeters.

In an embodiment of the present invention, a longitudinal length of the interface is between 0.6 millimeters and 9.5 millimeters.

In an embodiment of the present invention, the inner piece has a round shape.

In an embodiment of the present invention, the outer piece comprises a hollow structure.

The present invention further provides a light emitting diode lamp including a heat sink, a current control circuit, a LED light source and a connecting portion. The heat sink includes an inner piece and an outer piece. The inner piece has an upper surface, a lower surface opposite to the upper surface and a side surface connected to the upper surface and the lower surface. The outer piece is disposed around the inner piece and has an inner side surface, wherein the side surface of the inner piece is riveted to the inner side surface of the outer piece to form an interface, an area ratio of the interface and the side surface of the inner piece is between 0.6 and 0.95. The current control circuit is disposed on the inner piece of the heat sink and located in the upper surface. The LED light source is disposed on the current control circuit and electrically connected to the current control circuit. The connecting portion is disposed on inner piece of the heat sink and located in the lower surface.

In an embodiment of the present invention, a material constituting the inner piece comprises copper, aluminium, ceramic or aluminum nitride (AlN).

In an embodiment of the present invention, a material constituting the outer piece comprises aluminium.

In an embodiment of the present invention, a thickness of the inner piece is between 1 millimeter and 10 millimeters.

In an embodiment of the present invention, a longitudinal length of the interface is between 0.6 millimeters and 9.5 millimeters.

In an embodiment of the present invention, the upper surface of the inner piece and an upper portion of the inner side surface of the outer piece form a first accommodating space, and the current control circuit and the LED light source are disposed inside the first accommodating space.

In an embodiment of the present invention, the lower surface of the inner piece and a lower portion of the inner side surface of the outer piece form a second accommodating space, and the connecting portion is disposed inside the second accommodating space.

In an embodiment of the present invention, the inner piece of the heat sink has a round shape.

In an embodiment of the present invention, the outer piece of the heat sink comprises a hollow structure.

In an embodiment of the present invention, the current control circuit comprises a printed circuit board.

In an embodiment of the present invention, the LED light source comprises an LED package.

In an embodiment of the present invention, the LED lamp further comprises a lampshade connected to the heat sink.

As described above, in the present invention, the heat sink has an inner piece and an outer piece, and the inner piece is riveted to the outer piece, therefore the materials used in the manufacturing process of the heat sink can be reduced compared with that produced by the traditional technology, and the interface thermal resistance caused by the interface formed by the inner piece and the outer piece can be effectively reduced. In addition, the inner piece and the outer piece may be the different materials to enhance the heat dissipation efficiency of the heat sink.

In order to the make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
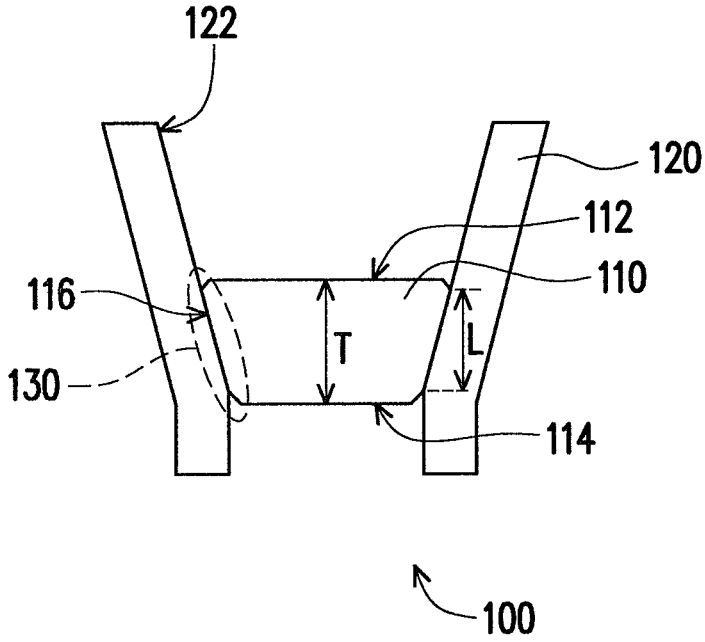
FIG. 1 is a cross-sectional view illustrating a heat sink according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a cross-sectional view illustrating a heat sink according to an embodiment of the present invention. Referring to FIG. 1, a heat sink 100 includes an inner piece 110 and an outer piece 120. Each element of the heat sink 100 and the connection relation between the elements are described below with reference to the accompanying drawings.

The inner piece 110 has an upper surface 112, a lower surface 114 opposite to the upper surface 112 and a side surface 116 connected to the upper surface 112 and the lower surface 114. In this embodiment of the present invention, the inner piece 110 has a round shape, and a thickness T of the inner piece 110 is between 1 millimeter and 10 millimeters. In addition, the inner piece 110 is made of metal material, and the metal material comprises copper, copper alloy, aluminium, aluminium alloy, composite material formed by copper or copper alloy, and composite material formed by aluminium or aluminium alloy, so as to enhance the heat dissipation efficiency of the heat sink 100. Certainly, the material of the inner piece 110 also can include ceramic or aluminum nitride (AlN).

The outer piece 120 is disposed around the inner piece 110 and has an inner side surface 122, wherein the side surface 116 of the inner piece 110 is riveted to the inner side surface 122 of the outer piece 120 to form an interface 130, and an area ratio of the interface 130 and the side surface 116 of the inner piece 110 is between 0.6 and 0.95. In this embodiment of the present invention, the outer piece 120 is, for example, a hollow structure, and a longitudinal length L of the interface 130 is between 0.6 millimeters and 9.5 millimeters. In addition, the outer piece 120 is made of metal material, and the metal material is, for example, aluminium or aluminium alloy, so as to enhance the heat dissipation efficiency of the heat sink 100.

In more details, in the present embodiment, the heat sink 100 may be fabricated with single material or a plurality of materials. In other words, the inner piece 110 and the outer piece 120 of the heat sink 100 may be fabricated with the same material or with different materials. For example, the manufacturing method of the heat sink 100 in the present embodiment, first, the outer piece 120 is made of aluminium of aluminium alloy by extrusion to provide a great heat dissipation function, and the raw materials used in the manufacturing process of the outer piece 120 can be reduced compared with that produced by the traditional technology. And then, the inner piece 110 having the same material of the outer piece 120 is provided. Finally, the side surface 112 of the inner piece 110 is riveted to the inner side surface 122 of the outer piece 120, so that the area ratio of the interface 130 and the side surface 116 of the inner piece 110 is between 0.6 and 0.95. Therefore, the interface thermal resistance can be effectively reduced and improved the heat dissipation efficiency. In addition, in order to improve the heat dissipation efficiency of the heat sink 100, the material of the inner piece 110 can be copper or other materials with high thermal conductivity, for example, so as to enhance the dissipation of the heat energy. The user can use the same or different materials to fabricate the inner piece 110 and outer piece 120 so the material of heat sink 100 herein is only illustrated as an example for one skilled in the art to implement the present invention, rather than limiting the scope of the present invention.

In brief, the heat sink 100 in the present embodiment has an inner piece 110 and an outer piece 120, and the inner piece 110 is riveted to the outer piece 120, therefore the raw materials used in the manufacturing process of the heat sink 100 can be reduced compared with that produced by the traditional technology, and the interface thermal resistance caused by the interface 130 formed by the inner piece 110 and the outer piece 120 can be effectively reduced. In addition, the inner piece 110 and the outer piece 120 may be the different materials, for example, the material of the inner piece 110 is copper, and the material of the outer piece 120 is aluminium. Since the material of the inner piece 110 can be selected from different materials other than aluminium, so as to enhance the heat dissipation efficiency of the heat sink 100.

Figure 2:
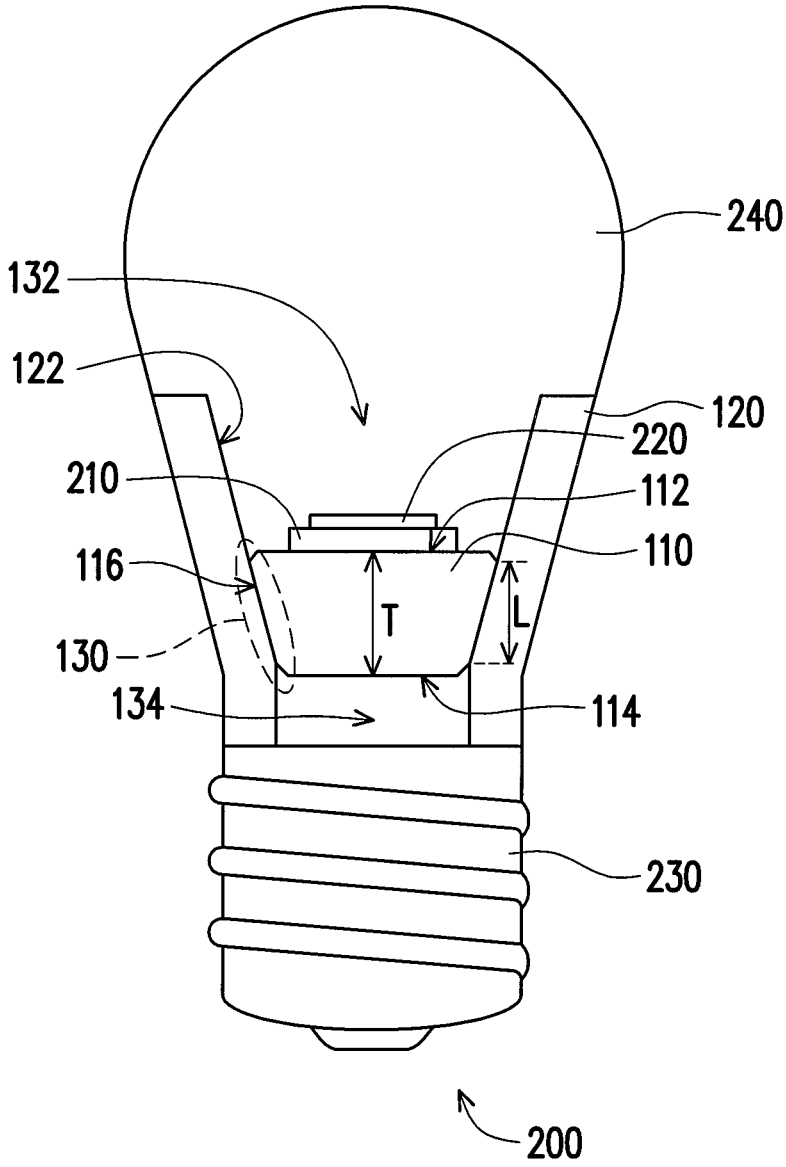
FIG. 2 is a cross-sectional view illustrating a light emitting diode lamp according to an embodiment of the present invention.

FIG. 2 is a cross-sectional view illustrating a light emitting diode lamp according to an embodiment of the present invention. Referring to FIG. 2, a light emitting diode lamp 200 includes a heat sink 100 described above, a current control circuit 210, a LED light source 220 and a connecting portion 230. The current control circuit 210 is disposed on the inner piece 110 of the heat sink 100 and located in the upper surface 112 of the inner piece 110. The LED light source 220 is disposed on the current control circuit 210 and electrically connected to the current control circuit 210. The connecting portion 230 is disposed on inner piece 110 of the heat sink 100 and located in the lower surface 114 of the inner piece 110.

In more detail, in the present embodiment, the upper surface 112 of the inner piece 110 and an upper portion of the inner side surface 122 of the outer piece 120 form a first accommodating space 132, and the current control circuit 210 and the LED light source 220 are disposed inside the first accommodating space 132. The lower surface 114 of the inner piece 110 and a lower portion of the inner side surface 122 of the outer piece 120 form a second accommodating space 134, and the connecting portion 230 is disposed on the second accommodating space 134. Further, the current control circuit 210 is, for example, a printed circuit board, which may be a circuit board with single circuit layer or a circuit board with a plurality of circuit layers. The LED light source 220 is, for example, an LED package which may be a SMD type package or other type of package. The connecting portion 230 may be included a connector (not shown) and a plurality of inner component (not shown) to conductor power to the LED light source 220 and the current control circuit 210.

In addition, the LED lamp 200 further comprises a lampshade 240 connected to the heat sink 100 to protect the LED light source 220. Generally speaking, mostly the lampshade 240 is fabricated by frosted glass or plastic material that allows light to pass through, and may diffuse light uniformly, so as to provide the glareless soft light.

As described above, the LED light source 220 is directly packaged on the inner piece 110 of the heat sink 100, so as to dissipate heat generated during the operation of the LED light source 220 by the inner piece 110 made of metal material, thereby improving the heat dissipation efficiency.

To sum up, in the present invention, the heat sink has an inner piece and an outer piece, and the inner piece is riveted to the outer piece, therefore the materials used in the manufacturing process of the heat sink can be reduced than that produced by the traditional technology, and the interface thermal resistance caused by the interface formed by the inner piece and the outer piece can be effectively reduced. Further, the inner piece and the outer piece may be the different materials, that is, the material of the inner piece can be copper of other materials with high thermal conductivity, so as to enhance the heat dissipation efficiency of the heat sink. Furthermore, the LED light source is directly packaged on the inner piece of the heat sink, so as to dissipate heat generated during the operation of the LED light source by the current control circuit pass to the inner piece of the heat sink, thereby improving the heat dissipation efficiency.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A heat sink used for dissipating heat generated by a light emitting diode (LED) module, comprising:

an inner piece having a side surface and having a body that from a round, flat base narrows to a round, flat tip, wherein the LED module comprising a current control circuit and a LED light source is disposed on the round, flat base; and a hollow outer piece disposed around the inner piece and having an inner side surface, wherein the side surface of the inner piece tightly fits the inner side surface of the outer piece so as to rivet together the outer piece and form an interface, and an area ratio of the interface and the side surface of the inner piece is between 0.6 and 0.95.

2. The heat sink as claimed in claim 1, wherein a material constituting the inner piece comprises copper, aluminium, ceramic or aluminum nitride (AlN).

3. The heat sink as claimed in claim 1, wherein a material constituting the outer piece comprises aluminium.

4. The heat sink as claimed in claim 1, wherein a thickness of the inner piece is between 1 millimeter and 10 millimeters.

5. The heat sink as claimed in claim 1, wherein a longitudinal length of the interface is between 0.6 millimeters and 9.5 millimeters.

6. A light emitting diode (LED) lamp, comprising:

a heat sink, comprises:

an inner piece having an upper surface, a lower surface opposite to the upper surface and a side surface connected to the upper surface and the lower surface; and an outer piece disposed around the inner piece and having an inner side surface, wherein the side surface of the inner piece is riveted to the inner side surface of the outer piece to form an interface, an area ratio of the interface and the side surface of the inner piece is between 0.6 and 0.95;

a current control circuit disposed on the inner piece of the heat sink and located in the upper surface;

a LED light source disposed on the current control circuit and electrically connected to the current control circuit; and a connecting portion disposed on inner piece of the heat sink and located in the lower surfaces;

wherein the upper surface of the inner piece and an upper portion of the inner side surface of the outer piece form a first accommodating space, and the current control circuit and the LED light source are disposed inside the first accommodating space, and wherein the lower surface of the inner piece and a lower portion of the inner side surface of the outer piece form a second accommodating space, and the connecting portion is disposed inside the second accommodating space.

7. The LED lamp as claimed in claim 6, wherein a material constituting the inner piece comprises copper, aluminium, ceramic or aluminum nitride (AlN).

8. The LED lamp as claimed in claim 6, wherein a material constituting the outer piece comprises aluminium.

9. The LED lamp as claimed in claim 6, wherein a thickness of the inner piece is between 1 millimeter and 10 millimeters.

10. The LED lamp as claimed in claim 6, wherein a longitudinal length of the interface is between 0.6 millimeters and 9.5 millimeters.

11. The LED lamp as claimed in claim 6, wherein the inner piece of the heat sink has a round shape.

12. The LED lamp as claimed in claim 6, wherein the outer piece of the heat sink comprises a hollow structure.

13. The LED lamp as claimed in claim 6, wherein the current control circuit comprises a printed circuit board.

14. The LED lamp as claimed in claim 6, wherein the LED light source comprises an LED package.

15. The LED lamp as claimed in claim 6, further comprises a lampshade, connected to the heat sink.

* * * * *